US009038936B1

(12) United States Patent
Maddern

(10) Patent No.: US 9,038,936 B1
(45) Date of Patent: May 26, 2015

(54) HAND HELD CABLE REEL ASSEMBLY

(71) Applicant: Russell Maddern, Kirrawee (AU)

(72) Inventor: Russell Maddern, Kirrawee (AU)

( * ) Notice: Subject to any disclaimer, the term of this patent is extended or adjusted under 35 U.S.C. 154(b) by 0 days.

(21) Appl. No.: 14/504,277

(22) Filed: Oct. 1, 2014

(51) Int. Cl.

| | |
|---|---|
| ***B65H 75/38*** | (2006.01) |
| ***B65H 75/44*** | (2006.01) |
| ***B65H 75/08*** | (2006.01) |
| ***B65H 75/40*** | (2006.01) |

(52) U.S. Cl.
CPC ..... *B65H 75/4492* (2013.01); *B65H 75/08* (2013.01); *B65H 75/406* (2013.01)

(58) Field of Classification Search
USPC ..... 242/405, 405.1–405.3, 407, 605, 612, 242/613
See application file for complete search history.

(56) References Cited

U.S. PATENT DOCUMENTS

| | | | | |
|---|---|---|---|---|
| 387,541 | A * | 8/1888 | Roe | 242/395.1 |
| 3,838,830 | A * | 10/1974 | Pettit | 242/395 |
| 4,022,398 | A * | 5/1977 | Youngblood | 242/395 |
| D263,371 | S * | 3/1982 | Allen | D8/358 |
| D359,440 | S * | 6/1995 | Stewart | D8/359 |
| 6,447,197 | B1 | 9/2002 | Hiura | |
| 6,609,676 | B2 | 8/2003 | Wilson | |
| 6,758,314 | B2 | 7/2004 | Woodruff | |
| 7,874,411 | B2 | 1/2011 | Roberts et al. | |
| 8,684,390 | B1 | 4/2014 | Barrette | |
| 8,757,532 | B2 | 6/2014 | Votel et al. | |
| 2004/0118962 | A1 * | 6/2004 | Limber | 242/405.2 |
| 2007/0029431 | A1 * | 2/2007 | Lai | 242/395 |
| 2008/0017745 | A1 * | 1/2008 | Laga | 242/395 |
| 2011/0247750 | A1 | 10/2011 | Kessler et al. | |

* cited by examiner

*Primary Examiner* — Sang Kim
(74) *Attorney, Agent, or Firm* — Andrew Alia, Esq.

(57) ABSTRACT

The present invention relates to a small lightweight hand held cable reel comprising a spool configured to rotate around a central ergonomic handle, wherein the spool comprises of two winder knobs for rotating the spool around the central ergonomic handle; smaller, larger locator holes and larger elongated slotted holes on the outer spool face for attaching a cable. The hand held cable reel further comprises elongated slotted holes on inner spool face for attaching to a webbing strap of clothing or equipment.

9 Claims, 4 Drawing Sheets

HAND HELD CABLE REEL ASSEMBLY

FIELD OF THE INVENTION

The present invention generally relates to a small light-weight cable reel for easy winding, storage and transport of winded cables and more specifically relates to a hand held cable reel assembly for easy handling and transport of wound cables or cords.

BACKGROUND OF THE INVENTION

Cable reels generally used for winding, storage and transportation of cables or cords basically consists of a spool, on which the cable is wound. Such cable reels are particularly useful in industrial or commercial settings such as automobile repair shops, machine shops, carpentry shops, construction sites and also in the military field as a mini reel for handling of hook and line cable, detonation cord, firing cable, hose, wire, rope, communication cable and Ethernet cable.

Hand held cable reels have been used for many years in a variety of different fields. Typically, cable reels are used to store a length of cable such as wire, rope, electrical cable or tape in a safe and secure manner until such time that the cable is required. When the cable is required for use the desired amount of cable may be paid out gradually from the cable reel in an orderly manner. When the desired amount of cable has been paid out, the cable may be secured to the cable reel to prevent further payout of cable from the reel.

Portable cable reel devices that are known in the prior art pose limitations such as difficulty in winding or unwinding the cable in a quick and efficient manner. In addition, another disadvantage of this type of reel is that the handles protrude from the end flanges by a significant distance thereby hindering compact storage of the device and also increases the production cost. Furthermore, the design of rotating knob or winding knobs on cable reels adds difficulty in winding of cable.

In addition, the selection of reel material contributing to its size and weight leads to difficulty in handling and transport of the cable reel. Cables are typically wound around a spool frame and secured at one or both ends. In order to maintain the cable on the spool, flanges are provided at both the ends which extends radially outwards to prevent the cable being removed from the spool. Conventional reels include a shaft positioned at the center of the reel to receive an axle that allows rotation of reel over the shaft to facilitate winding or unwinding of cable.

US patent publication 20100044490 A1 discloses a hand held cable reel comprising a central cable receiving core flanked by disc flanges with a handle for rotational winding. U.S. Pat. No. 6,186,433 B1 shows a manual wound cord storage unit comprising a reel frame with a central hub and a spool with a winding knob. U.S. Pat. No. 7,874,411 B2 discloses a reel for maintaining fiber optic cable assemblies. U.S. Pat. No. 8,074,916 B2 shows a cable reel assembly comprising multiple carrying handles on side flanges of the spool.

Cable reels are used in various industries for winding, storage and transport of cable, wire, rope, cord, hose, and the like. Several limitations exist in cable reels known in the art including weight, problems associated with stacking, bulkiness which adds difficulty in handling and manufacturing. Therefore there exists a need for a small hand held cable reel assembly that is lower in weight, easily stackable, less bulky and easy to handle and manufacture.

SUMMARY OF THE INVENTION

The present invention relates to a small hand held cable reel assembly comprising a spool configured to rotate around a central ergonomic handle, wherein the spool comprises; a plurality of winder knobs for rotating the spool around the central ergonomic handle; a plurality of locator hole, elongated slotted hole on outer spool face for attaching a cable and a plurality of elongated slotted hole on inner spool face for attaching to a webbing strap of clothing or equipment.

In an embodiment, the central ergonomic handle comprises an outer half with a recessed surface for finger grip and an inner half with a flat surface for palm rest which prevents a holding hand to come in contact with the spool. The inner half and the outer half of the central ergonomic handle are coupled together by chemical welding.

DETAILED DESCRIPTION OF THE INVENTION

Figure 1A:
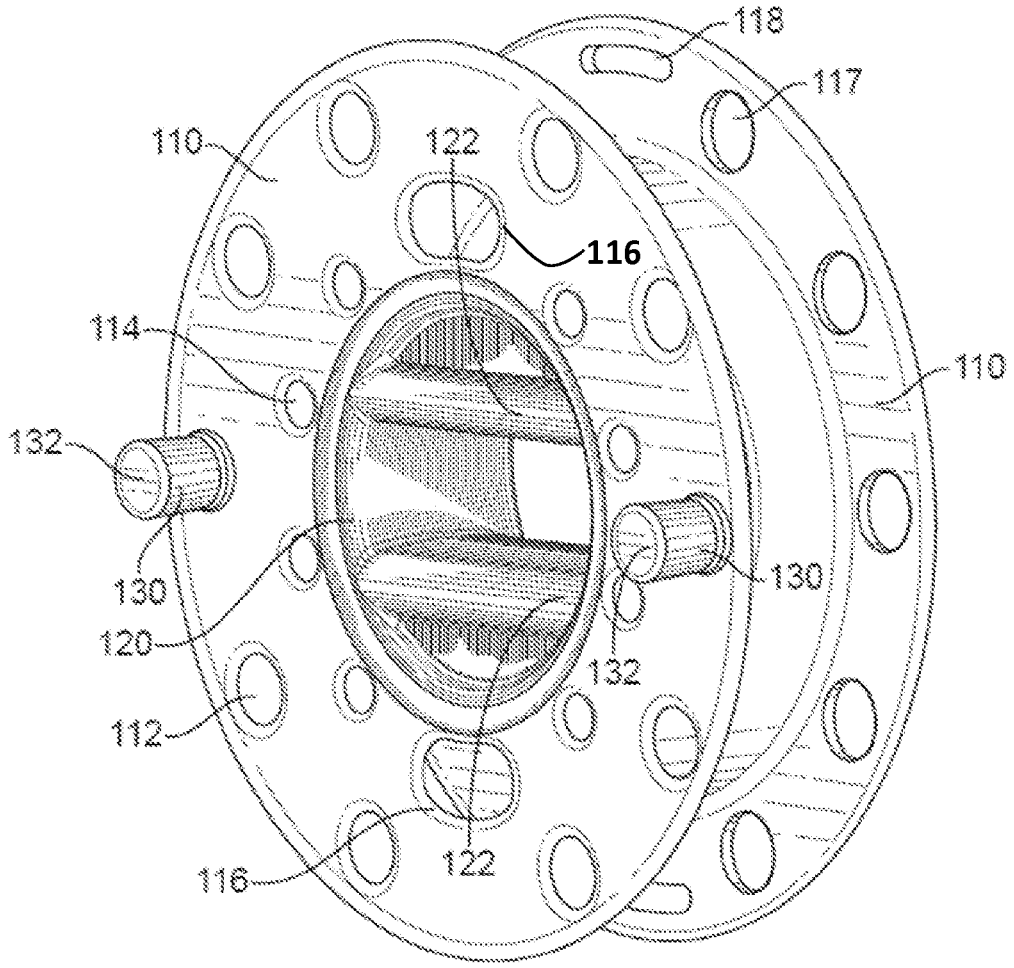
FIG. 1*a* shows an assembled view of a hand-held cable assembly according to an embodiment of the invention.

Referring to FIG. 1*a* which shows an assembled view of a hand held cable reel assembly according to an embodiment of the invention, comprises a spool 110 configured to rotate around a central ergonomic handle 120, wherein the spool 110 comprises two winder knobs 130 attached to the outer spool face using a press fit winder knob retainer 132. The winder knobs 130 are used for rotating the spool 110 around the central ergonomic handle 120. The spool 110 comprises a plurality of locator holes of different sizes 112, 114 and elongated slotted hole 116 on the outer spool face for attaching a cable to the cable assembly. The spool 110 further comprises elongated slotted holes 118 on inner spool face for attaching to a webbing strap on clothing or equipment for carrying the cable reel assembly.

The central ergonomic handle 120 comprises an outer face 122 characterized with a recessed surface forming a grip for fingers of the holding hand. The locator holes 117 allow insertion of winder knobs 130 to facilitate stacking multiple reels together thereby aiding in easy transport and storage. The central ergonomic handle 120 comprises a textured surface to provide grip to the holding hand. In an embodiment, the central ergonomic handle 120 is designed to accommodate a gloved hand such as used by military personnel and law enforcement officers.

Figure 1B:
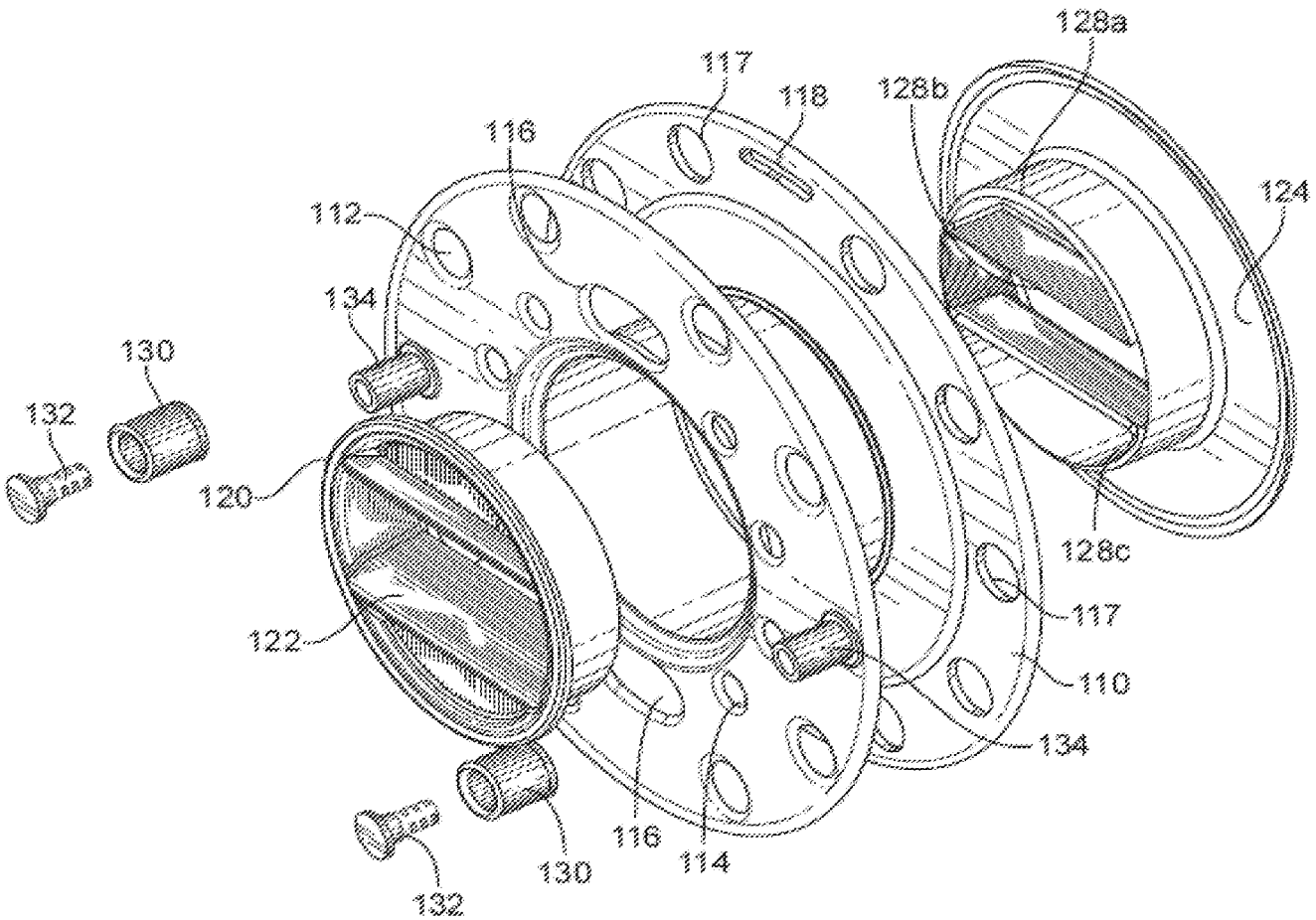
FIG. 1*b* illustrates an exploded view of the hand-held cable assembly according to an embodiment of the invention.

FIG. 1*b* shows an exploded view of a hand held cable reel according to an embodiment of the invention. The central ergonomic handle 120 comprises an outer half 122 characterized with a recessed surface forming a grip for fingers of the holding hand and an inner half 124 characterized with a large flat surface forming a rest for the palm of the holding hand while carrying and operating the cable reel. The outer half 122 and the inner half 124 of the central ergonomic handle 120 are joined together by chemical welding in order to form a complete hand grip. In an embodiment, the two halves 122, 124 of central ergonomic handle 120 are welded chemically using the welding joints 128*a*, 128*b* and 128*c*. The spool 110 further comprises a winder knob locator 134 upon which the winder knob 130 is permanently attached to the spool 110 using a press fit winder knob retainer 132. The large flat surface on the inner face 124 also prevents the holding hand from coming in contact with the spool 110 while holding or operating the reel assembly.

Elongated slotted holes comprises of smaller elongated slotted holes 118 on the inner spool face capable of attaching a webbing strap on clothing or equipment for carrying purposes whereas larger elongated slotted holes 116 are present on the outer spool face for attaching a cable or a hook or cord to the cable reel assembly. Similarly, the locator holes comprises larger locator holes 112 for attaching cables and also large locator holes 117 acting as stacking locator allow insertion of winder knobs 130 to facilitate stacking multiple reels together thereby aiding in easy transport and storage. Smaller locator holes 114 on the outer spool face are used for attaching to a cable.

In an embodiment, the design of the small hand held cable reel allows easy holding using either hand and winding using the other hand. The cable reel assembly can be held by slipping the fingers through the central ergonomic handle 120 such that the fingers will rest on the recessed surface on outer half 122 while palm of the holding hand would rest on the large flat surface on inner half 124 of the handle 120. Using other hand, the spool 110 can be rotated around the central handle 120, using either winder knob 130 in order to perform winding of a cable onto the hand held cable reel.

Figure 2:
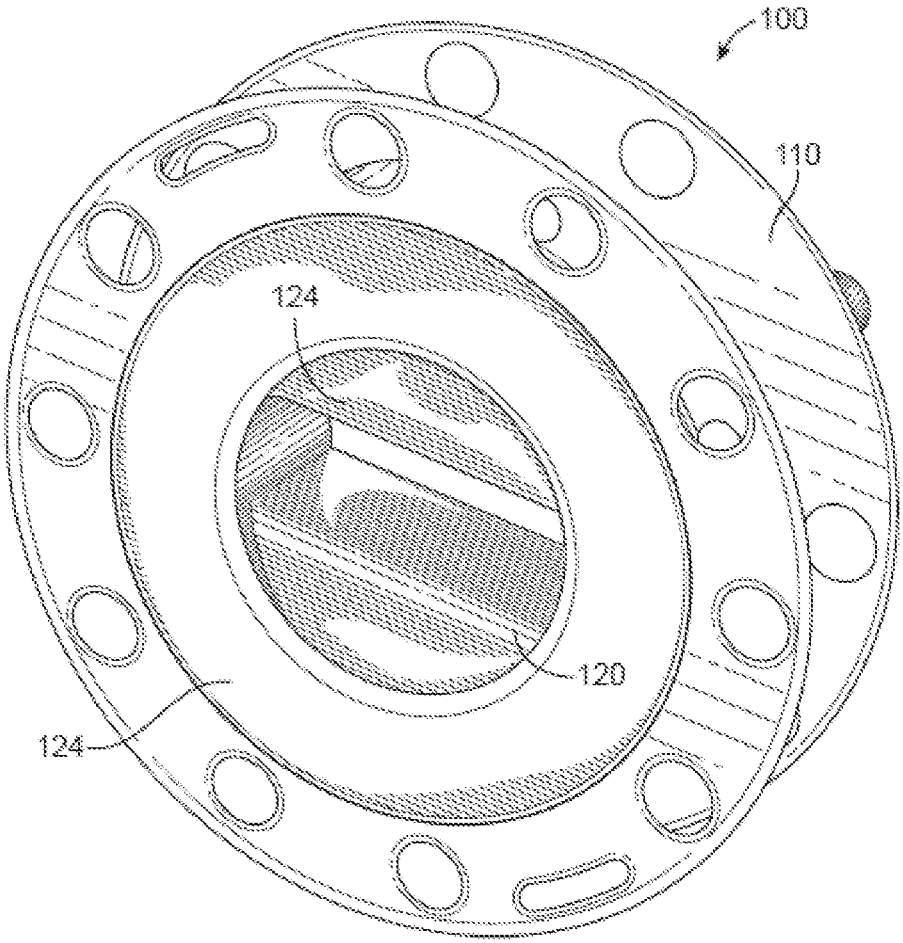
FIG. 2 shows a rear view of the hand-held cable assembly according to an embodiment of the invention.

FIG. 2 shows a rear view of the small hand held cable reel assembly according to an embodiment, the central ergonomic handle 120 pivoted centrally into the spool 110, allowing rotation of the spool 110 around the central ergonomic handle 120. The inner half 124 of the central ergonomic handle 120 is characterized with a large flat surface for resting the palm of the holding hand. The large flat surface also prevents the holding hand from touching the spool 110.

The spool, central ergonomic handle, winder knob and its retainer components are fabricated using light weight, stabilized plastic or thermoplastic material which is recyclable and also possesses properties including impact resistance, flame resistance, temperature tolerance, chemical resistance, and its combinations thereof. The light weight material of the cable reel facilitates easy handling and transport, whereas its stabilized structure offers durability.

Figure 3:
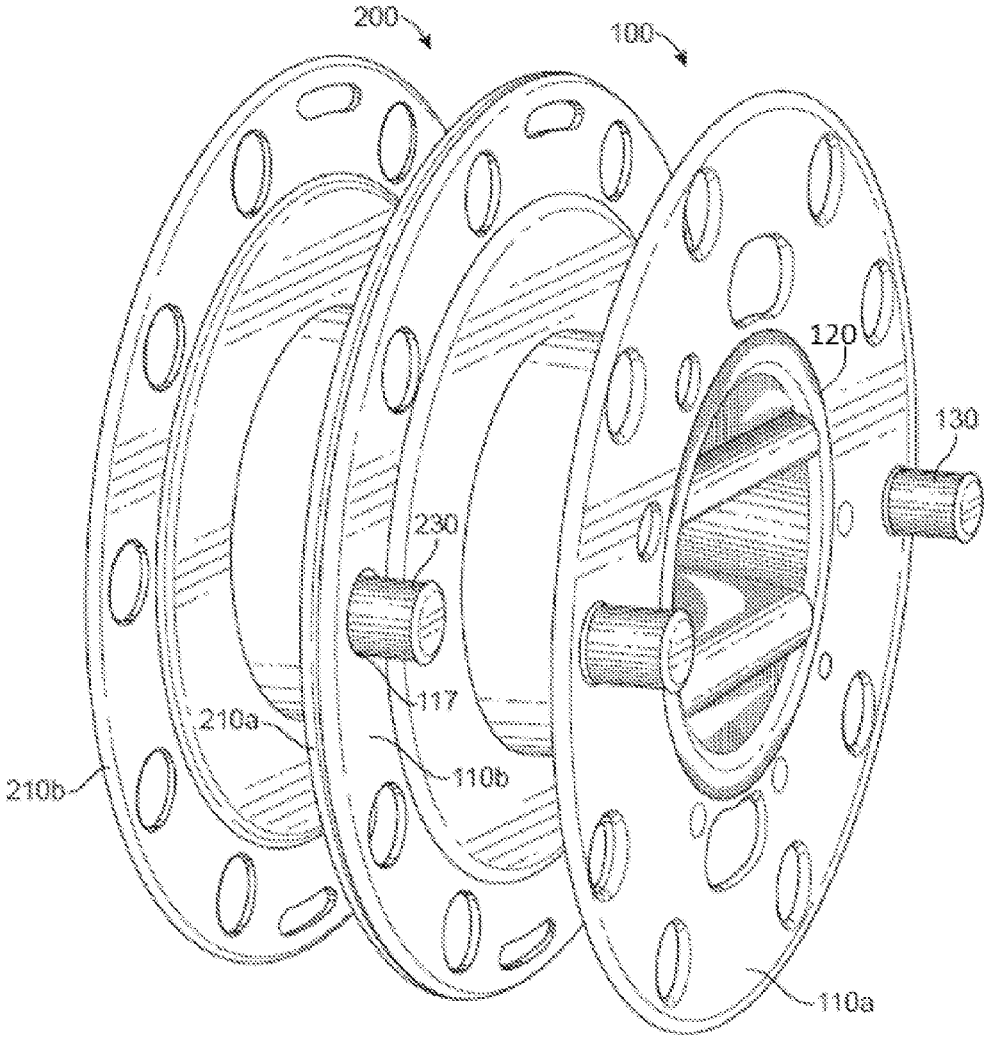
FIG. 3 shows a stacked view of the hand-held cable assembly according to an embodiment of the invention.

FIG. 3 shows a stacked view of the small hand held cable reel assembly according to an embodiment. Cable reel 100 comprising a spool with outer face 110*a* with a winder knob 130 and inner face 110*b* is stacked over another cable reel 200 comprising a spool with outer face 210*a* and inner face 210*b*. The cable reel assembly 100 comprises a stacking locator hole 117 for accommodating the winder knob 230 protruding from the cable reel 200 during stacked position. The stacking locator hole 117 facilitates easy stacking of cable reels during storage and transport.

In an embodiment, the spool outer face 110*a* further comprises a hole or a slot for attaching one end of the cable to be wound thereby permitting easy and rapid winding of the cable. One end of the cable is attached to the slot or hole followed by rotation of the spool faces 110*a*, 110*b* in the unstacked position using winder knob 130 around the axis of center ergonomic handle 120 allowing easy winding.

The hand held cable reel of the present invention can be used in a wide range of industry including construction, electrical, military, law enforcement, adventure sport, communication and the like. The small hand held cable reel aids in tangle free handling and easy winding of wire, cord, rope, tape, hose, hook and line.

Unlike the existing portable cable reels that comprise handles external to the spool, adds bulkiness and cannot be stacked without consuming a significant amount of storage space, the hand held cable reel of present invention with a central ergonomic handle allows easy lightweight operation, carrying and storage.

The invention claimed is:

1. A small lightweight, stackable hand held cable reel comprising:

a central ergonomic handle (120) configured to slip the user's fingers through, the handle comprising an outer half with a recessed surface for finger grip (122) and an inner half for a palm rest (124);

a spool (110) configured to rotate around the central ergonomic handle, wherein the spool comprises;

of two winder knobs (130) for rotating the spool around the central ergonomic handle;

a plurality of locator holes (112, 114) on an outer and an inner spool face for attaching a cable and for accommodating the two winder knobs of multiple cable reels during stacking; and, two elongated slotted holes (116) on the outer spool face for attaching to a cable; and, two small elongated holes (118) on the inner spool face for attaching webbing straps to clothing or equipment.

2. The hand held cable reel of claim 1, wherein the central ergonomic handle comprises an inner half with a flat surface for palm rest which prevents a holding hand to come in contact with the spool.

3. The hand held cable reel of claim 2, wherein the central ergonomic handle comprises the outer half and the inner half coupled together to form a complete handle, wherein the spool is able to rotate around the handle while the handle is stationary.

4. The hand held cable reel of claim 1, wherein the two winder knobs are attached to the spool using a press fit winder knob retainer.

5. The hand held cable reel of claim 1 is fabricated from a plastic or thermoplastic material.

6. The hand held cable reel of claim 5, wherein the plastic is a light weight, durable stabilized plastic able to provide easy handling and transport.

7. The hand held cable reel of claim 5, wherein the plastic is recyclable.

8. The hand held cable reel of claim 1 is fabricated from a material with properties selected from a group consisting of impact resistant, temperature tolerant, chemical resistant, flame retardant and any combination thereof.

9. The hand held cable reel of claim 1, wherein the cable reel is suitable for use by military personnel and law enforcement officers.

* * * * *